US007290913B2

(12) United States Patent
Watanabe et al.

(10) Patent No.: US 7,290,913 B2
(45) Date of Patent: Nov. 6, 2007

(54) LIGHT EMITTING MODULE AND LIGHTING UNIT

(75) Inventors: Shigeyuki Watanabe, Shizuoka (JP); Hironori Tsukamoto, Shizuoka (JP); Yukio Nomura, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 162 days.

(21) Appl. No.: 11/199,248

(22) Filed: Aug. 9, 2005

(65) Prior Publication Data

US 2006/0044840 A1 Mar. 2, 2006

(30) Foreign Application Priority Data

Aug. 24, 2004 (JP) ..... P.2004-244435

(51) Int. Cl.
*F21V 101/02* (2006.01)

(52) U.S. Cl. ..... 362/545; 362/800; 362/396; 362/457

(58) Field of Classification Search ..... 362/612, 362/555, 396, 457, 458, 800, 545, 544, 543
See application file for complete search history.

(56) References Cited

U.S. PATENT DOCUMENTS

2001/0003504 A1* 6/2001 Ishihara et al. ..... 362/31
2003/0099114 A1* 5/2003 Ohara ..... 362/555
2003/0198060 A1 10/2003 Hiroyuki et al.
2004/0012976 A1* 1/2004 Amano ..... 362/511

FOREIGN PATENT DOCUMENTS

JP 6-89601 A 3/1994

* cited by examiner

*Primary Examiner*—Laura Tso
(74) *Attorney, Agent, or Firm*—Sughrue Mion, PLLC

(57) ABSTRACT

A lighting unit to be used for illumination includes an LED unit having a semiconductor light emitting unit, a radiating board for directly fixing the semiconductor light emitting unit to an upper surface, and a contact formed on the radiating board and serving to input a power to cause the semiconductor light emitting unit to emit a light, an attachment having a power supply portion for surrounding and holding the LED unit and supplying a power to cause the semiconductor light emitting unit to emit a light from an external power plug to the contact in a state in which at least a part of lower and side surfaces of the radiating board and an upper part of the semiconductor light emitting unit are open.

17 Claims, 15 Drawing Sheets

LIGHT EMITTING MODULE AND LIGHTING UNIT

This application claims foreign priority from Japanese Patent Application No. 2004-244435, filed Aug. 24, 2004, the entire disclosure of which is herein incorporated by reference.

BACKGROUND OF THE INVENTION

1. Field of the Invention

The present invention relates to a light emitting module and a lighting unit. More particularly, the invention relates to a light emitting module using a semiconductor light emitting unit as a light source, and a lighting unit.

2. Description of Related Art

In a lighting unit for a vehicle such as a headlamp for a vehicle, the formation of a light distribution pattern with high precision is required for safety. The light distribution pattern is formed by an optical system using a reflecting mirror or a lens. For example, JP-A-6-89601 Publication (Pages 3 to 7, FIGS. 1 to 14) discloses this type of system. In recent years, moreover, a semiconductor light emitting unit has been utilized as the light source of the headlamp for a vehicle.

In the case in which a semiconductor light emitting unit is used as the light source of a lighting unit, it is necessary to efficiently cause the semiconductor light emitting unit to emit a light, thereby satisfying a light quantity level required for the lighting unit. In order to efficiently cause the semiconductor light emitting unit to emit a light, it is necessary to prevent a reduction in luminance due to a heat. Since the semiconductor light emitting unit has a small size, it has a smaller light emitting region than that in a conventional light source. Accordingly, in order to form a light distribution pattern with high precision, the relative positions of the optical system, such as a lens or a shade, with the semiconductor light emitting unit must be managed with high precision.

SUMMARY OF THE INVENTION

A first aspect of the invention is directed to a light emitting module to be used for a lighting unit, comprising an LED unit having a semiconductor light emitting unit, a radiating board for directly fixing the semiconductor light emitting unit to an upper surface, and a contact formed on the radiating board and serving to input a power to cause the semiconductor light emitting unit to emit a light, and an attachment having a power supply portion for surrounding and holding the LED unit and supplying a power to cause the semiconductor light emitting unit to emit a light from an external power plug to the contact in a state in which at least a part of lower and side surfaces of the radiating board and an upper part of the semiconductor light emitting unit are open. According to such a structure, it is possible to implement a light emitting module in which a heat emitted from the semiconductor light emitting unit is efficiently radiated to maintain a high luminance and a light source has high precision in a position. Moreover, the attachment surrounds and holds the LED unit. Consequently, there is no possibility that hands or tools might touch the contact and foreign matters can be thus prevented from sticking to the contact.

In the light emitting module, the attachment may have an attachment body for positioning the LED unit and a lower surface support member slid and fitted in the attachment body from a side and serving to interpose and hold the LED unit together with the attachment body. According to such a structure, it is not necessary to provide a downward guide slant face which is required when the lower surface support member is to be fitted in the attachment body from below. Accordingly, it is possible to reduce the height of the light emitting module.

In the light emitting module, the attachment body may include the power supply portion, the lower surface support member may support the lower surface of the radiating board, and the power supply portion may downward energize the contact formed on an upper surface of the radiating board, thereby carrying out an electrical connection to the contact. According to such a structure, it is possible to stably implement the hold of the radiating board and the supply of a power by the energizing force of the power supply portion.

In the light emitting module, the lower surface support member may support a portion in the lower surface of the radiating board which is opposed to the contact. According to such a structure, it is possible to reliably maintain the electrical connection of a spring terminal and the contact.

Moreover, a second aspect of the invention is directed to a lighting unit to be used for illumination, comprising an LED unit having a semiconductor light emitting unit, a radiating board for directly fixing the semiconductor light emitting unit to an upper surface, and a contact formed on the radiating board and serving to input a power to cause the semiconductor light emitting unit to emit a light, an attachment having a power supply portion for surrounding and holding the LED unit and supplying a power to cause the semiconductor light emitting unit to emit a light from an external power plug to the contact in a state in which at least a part of lower and side surfaces of the radiating board and an upper part of the semiconductor light emitting unit are open, and a light source pedestal having a support surface for supporting the LED unit in direct contact with the lower surface of the radiating board, and a positioning portion for positioning the LED unit in direct abutment on the side surface of the radiating board. According to such a structure, it is possible to implement a lighting unit in which the semiconductor light emitting unit has a high light emitting efficiency and the light source has high precision in a position.

The lighting unit may further comprise an engagement surface formed in almost parallel with the support surface below the support surface in the light source pedestal and a clip for interposing an upper surface of the attachment and the engagement surface, thereby pressing the lower surface of the radiating board against the support surface through the attachment. According to such a structure, it is possible to efficiently radiate the heat of the semiconductor light emitting unit by reliably causing the back face of the radiating board to adhere to the light source pedestal.

In the lighting unit, the power supply portion may downward energize the contact formed on an upper surface of the radiating board, thereby carrying out an electrical connection to the contact, and the clip may interpose the upper surface of the attachment and the engagement surface so that the power supply portion can energize the contact more strongly. Consequently, it is possible to enhance the reliability of the electrical connection of the contact and the power supply portion.

In the lighting unit, the attachment may further have a regulating rib to abut on a side surface in the radiating board which is provided on an opposite side of the positioning portion of the light source pedestal, and the clip may press a side surface of the attachment toward the light source pedestal so that the regulating rib can press the radiating board against the positioning portion, thereby positioning the LED unit. Consequently, it is possible to reliably position the radiating board with respect to the light source pedestal.

BRIEF DESCRIPTION OF THE DRAWINGS

The advantages, nature and various additional features of the invention will appear more fully upon consideration of the exemplary embodiment of the invention which is schematically set forth in the drawings, in which.

DETAILED DESCRIPTION OF THE EXEMPLARY EMBODIMENT

Although the invention will be described below with reference to exemplary embodiment thereof, the following exemplary embodiment does not restrict the invention.

Figure 1:
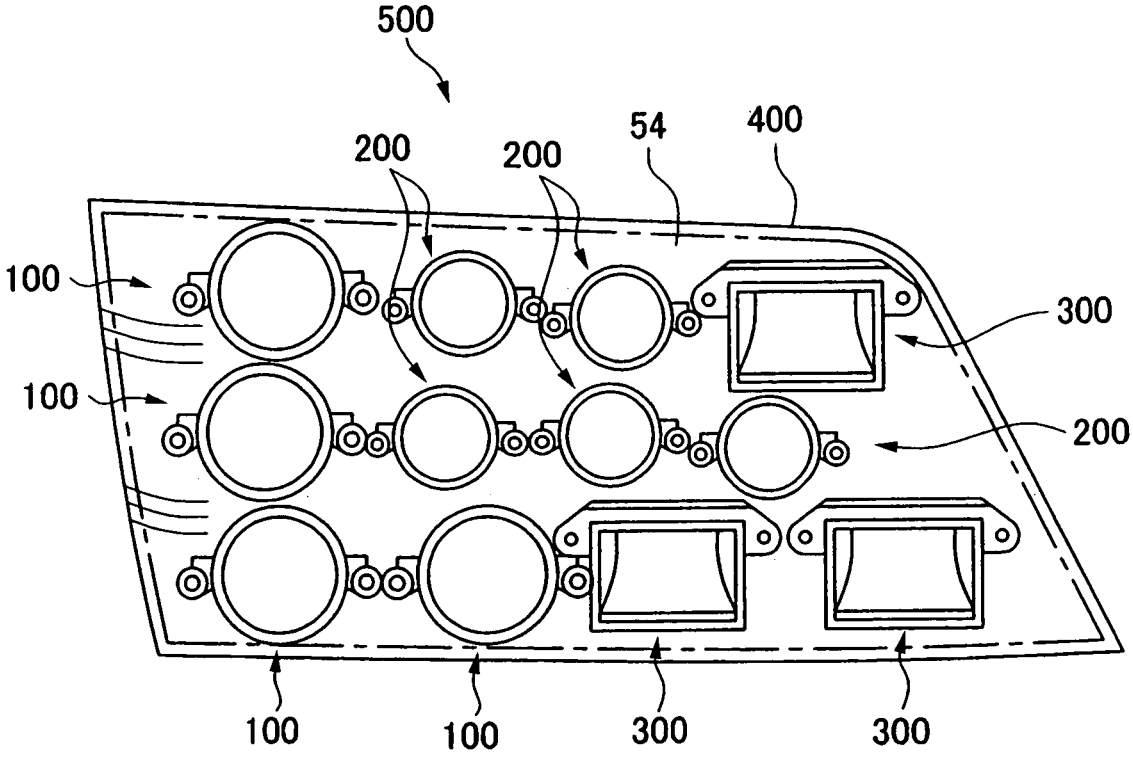
FIG. 1 is a front view showing a lighting unit 500 for a vehicle.
Figure 2:
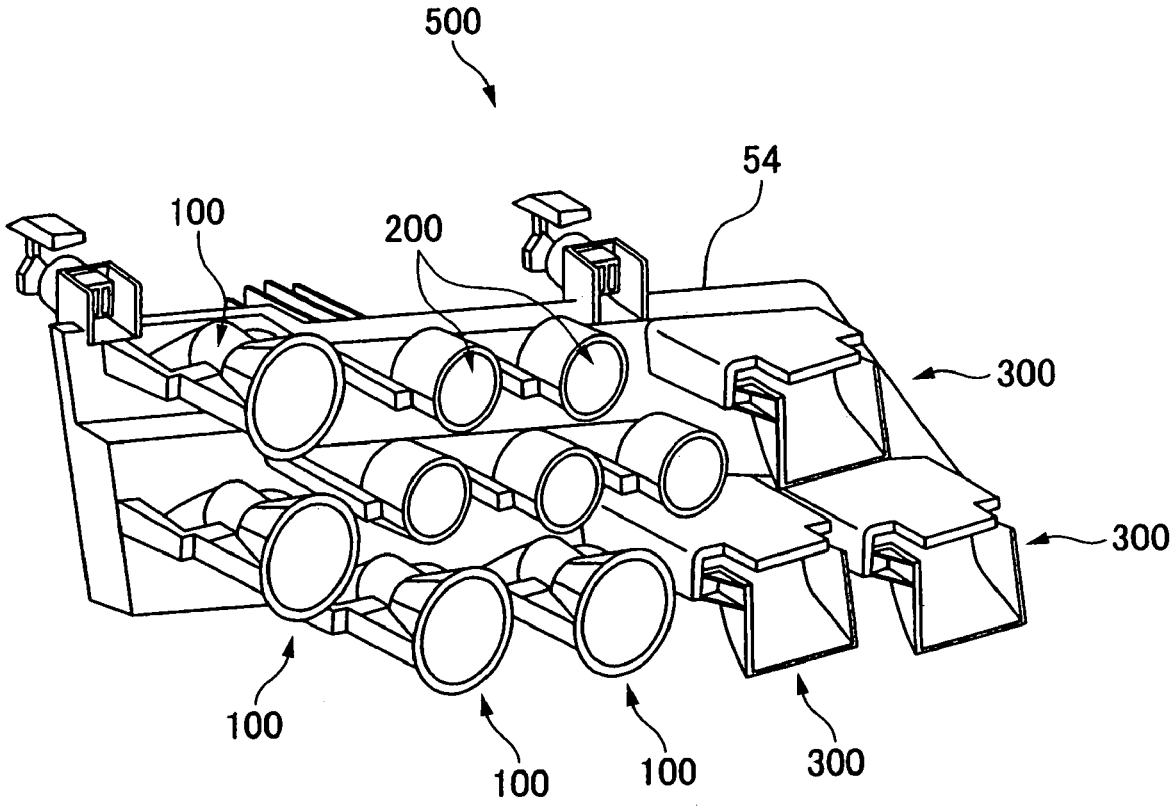
FIG. 2 is a perspective view showing the lighting unit 500 for a vehicle as seen from an oblique and forward view.

FIGS. 1 and 2 illustrate an example of the structure of a lighting unit 500 for a vehicle according to an exemplary embodiment of the invention. FIG. 1 is a front view showing the lighting unit 500 for a vehicle. FIG. 2 is a perspective view showing the lighting unit 500 for a vehicle with a transparent cover 400, shown in FIG. 1, removed. FIG. 2 is seen from an oblique and forward view. In the exemplary embodiment, it is assumed that longitudinal, transverse and vertical directions are coincident with the longitudinal, transverse and vertical directions of the vehicle, respectively.

The lighting unit 500 for a vehicle is a headlamp for irradiating, for example, a low beam. The lighting unit accommodates a plurality of light source units 100, 200 and 300 in a lamp housing constituted by the transparent cover 400 and a bracket 54. The light source units are classified into the first light source unit 100 having a circular shape and having a comparatively large diameter, the second light source unit 200 having a circular shape and having a comparatively small diameter, and the third light source unit 300 which has a rectangular shape. Each of the light source units has, as a light source, a semiconductor light emitting unit which will be described below, and each of the light units irradiates a light generated from the semiconductor light emitting unit from the forward part of the vehicle. The semiconductor light emitting unit can be, for example, a light emitting diode unit (LED) or a laser diode.

The light source units are attached to the bracket 54, which can be turned downward at an angle of approximately 0.5 to 0.6 degrees with respect to the forward part of the vehicle. The bracket 54 is tiltably attached to the lighting unit 500 for a vehicle by means of an aiming mechanism for regulating the direction of the optical axis of the light source unit. The light source units 100, 200 and 300 have predetermined light distribution patterns. The light source units 100, 200, 300 collectively form a light distribution pattern required for the lighting unit 500 for a vehicle.

Figure 3:
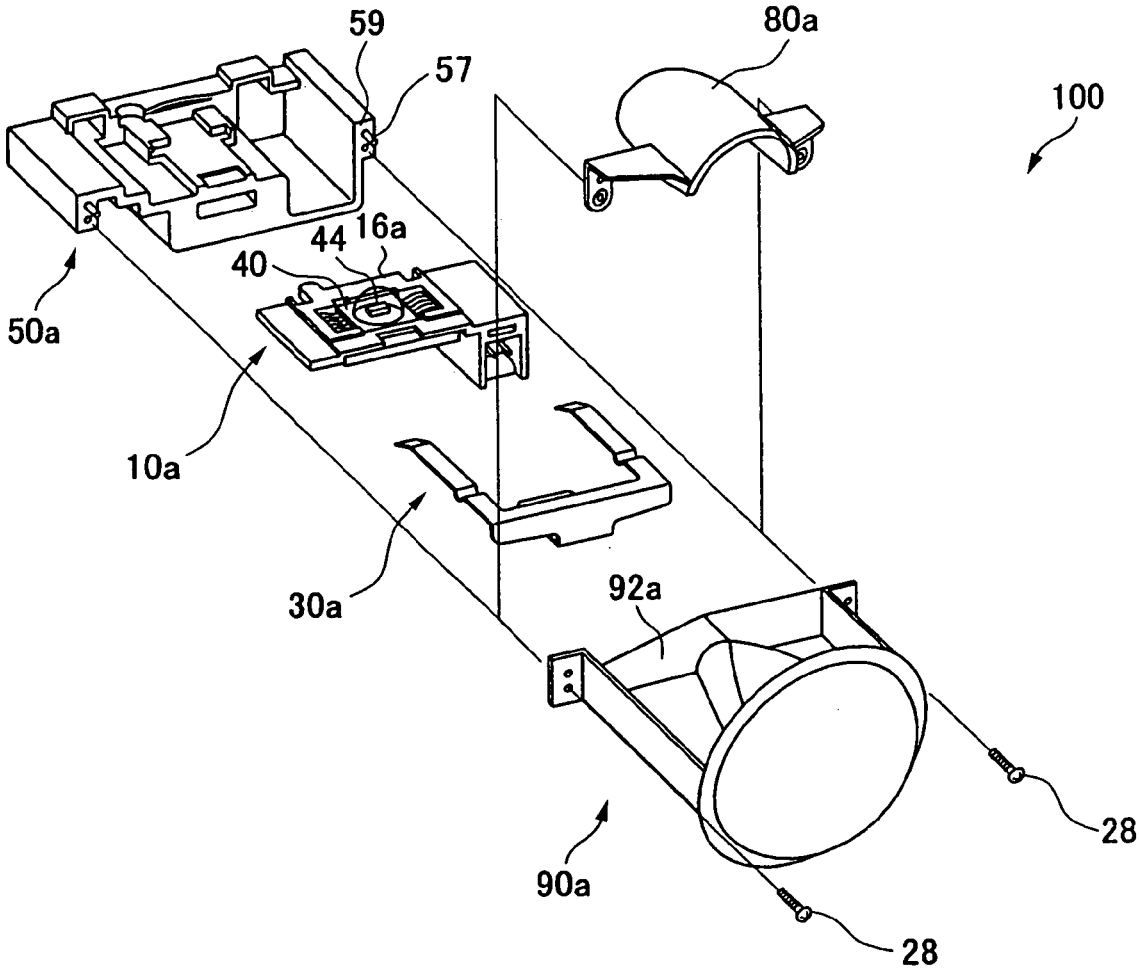
FIG. 3 is an exploded perspective view showing a first light source unit 100.

FIG. 3 is an exploded perspective view showing the first light source unit 100. The first light source unit 100 provides an intense irradiation of light on a comparatively small range in the light distribution pattern of the lighting unit 500 for a vehicle. The first light source unit 100 comprises a light emitting module 10*a* including an LED unit 40 having a semiconductor light emitting unit 44 mounted thereon and an attachment 16*a* for surrounding and holding the LED unit 40, a light source pedestal 50*a* for positioning and supporting the light emitting module 10*a*, a clip 30*a* for fixing the light emitting module 10*a* to the light source pedestal 50*a*, a reflector 80*a* for reflecting a light emitted from the semiconductor light emitting unit 44 onto the forward part of the lighting unit, a lens 90*a* for projecting the light reflected by the reflector 80*a* onto the forward part of the lighting unit, and screws 28 for fastening the reflector 80*a* and the lens 90*a* to the light source pedestal 50*a*. The light emitting module 10*a* holds the LED unit 40 with a part of lower and side surfaces of the LED unit 40 exposed. The light source pedestal 50*a* directly positions the exposed lower and side surfaces of the LED unit 40.

The reflector 80*a* is an almost dome-shaped member fixed above the semiconductor light emitting unit 44. The reflector 80*a* has, on an inside surface, a reflecting plane having the shape of part of an almost elliptical sphere, with the optical axis of the first light source unit 100 as a central axis of the elliptical sphere. Specifically, the reflecting plane is formed so that a section of the reflecting plane has the shape of almost ¼ ellipse, in which common vertex is provided rearward from the semiconductor light emitting unit 44. By such a shape, the reflector 80*a* collects a light emitted from the semiconductor light emitting unit 44 and reflects the light forward close to the optical axis of the lens 90*a*. The lens 90*a* includes a shade 92*a* on a side of the lens 90*a* that is provided close to the LED unit 40. The shade 92*a* shields or reflects a part of a light reflected from the reflector 80*a*, thereby causing a ray forming the light distribution pattern of the first light source unit 100 to be incident on the lens portion.

The light source pedestal 50*a* has an assembly reference plane 59. The assembly reference plane 59 determines positions in the direction of the optical axis of the reflector 80*a* and the lens 90*a* in relation to the direction of irradiation of the lighting unit 500 for a vehicle with high precision with respect to the light source pedestal 50*a*, and a positioning projection 57 protruded from the assembly reference plane 59 almost perpendicularly. The positioning projection 57 determines the positions of the reflector 80*a* and the lens 90*a* in a perpendicular direction to the optical axis with high precision.

Thus, all of the LED unit 40, the reflector 80*a* and the lens 90*a* can be positioned with respect to the light source pedestal 50*a* with high precision and are fixed in this state. Consequently, the relative positions of the reflector 80*a* and the lens 90*a* with respect to the semiconductor light emitting unit 44 are determined with high precision. Accordingly, the light generated from the semiconductor light emitting unit 44 can be caused to be incident on the lens 90*a* with high precision, thereby forming a light distribution pattern with high precision in the forward part of the vehicle. The reflector 80*a* and the lens 90*a* are taken as a non-limiting example of the optical member according to the invention.

Figure 4:
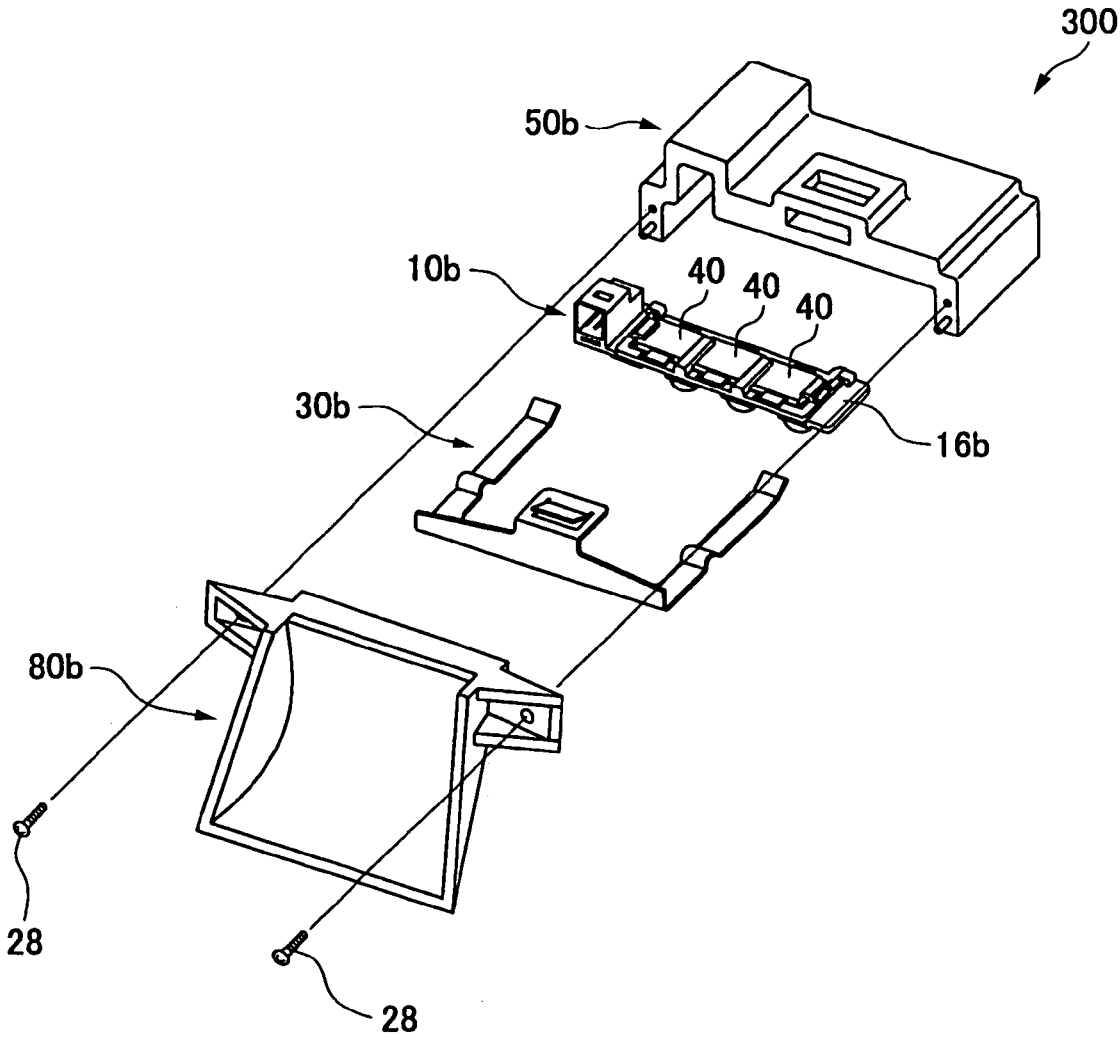
FIG. 4 is an exploded perspective view showing a third light source unit 300*a*.

FIG. 4 is an exploded perspective view showing the third light source unit 300. The third light source unit 300 is designed to irradiate a light having the largest range in a transverse direction in the light distribution pattern of the lighting unit 500 for a vehicle. The third light source unit 300 includes an oblong light emitting module 10*b* having a plurality of LED units 40 arranged and mounted in a line, a light source pedestal 50*b* for positioning the light emitting module 10*b* thereon in a downward and transverse direction, a clip 30*b* for fixing the light emitting module 10*b* with respect to the lower surface of the light source pedestal 50*b*, and a reflector 80*b* for irradiating a light emitted downward from the semiconductor light emitting unit 44 over the forward part of the lighting unit 500 for a vehicle.

The inner reflecting plane of the reflector 80*b* has a section that is vertical with respect to the longitudinal direction of the lighting unit 500 for a vehicle. The vertical section includes a portion that is the shape of an almost ¼ ellipse. The vertex of a major axis of the ellipse is provided in contact with the light source pedestal 50*b*. The whole region of the internal reflecting plane of the reflector is provided behind the semiconductor light emitting unit 44. By such a shape, the reflector 80*b* irradiates lights emitted from the semiconductor light emitting units 44 arranged in the transverse direction over the largest range in the transverse direction in the light distribution pattern of the lighting unit 500 for a vehicle, and furthermore, provides a light within a constant range which is smaller in the vertical direction than that in the transverse direction.

Figure 5:
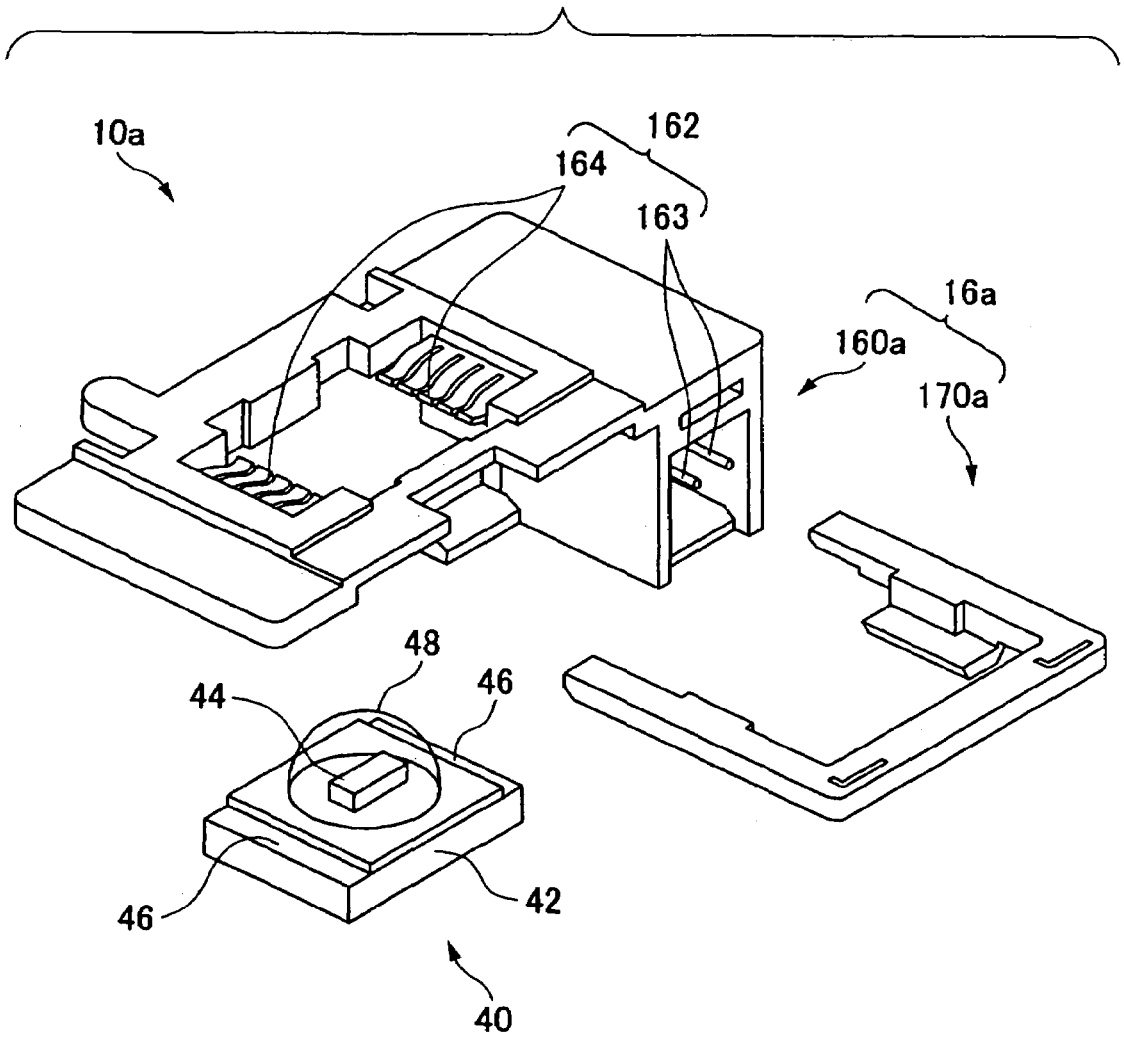
FIG. 5 is an exploded perspective view showing a light emitting module 10*a* seen from above.
Figure 6:
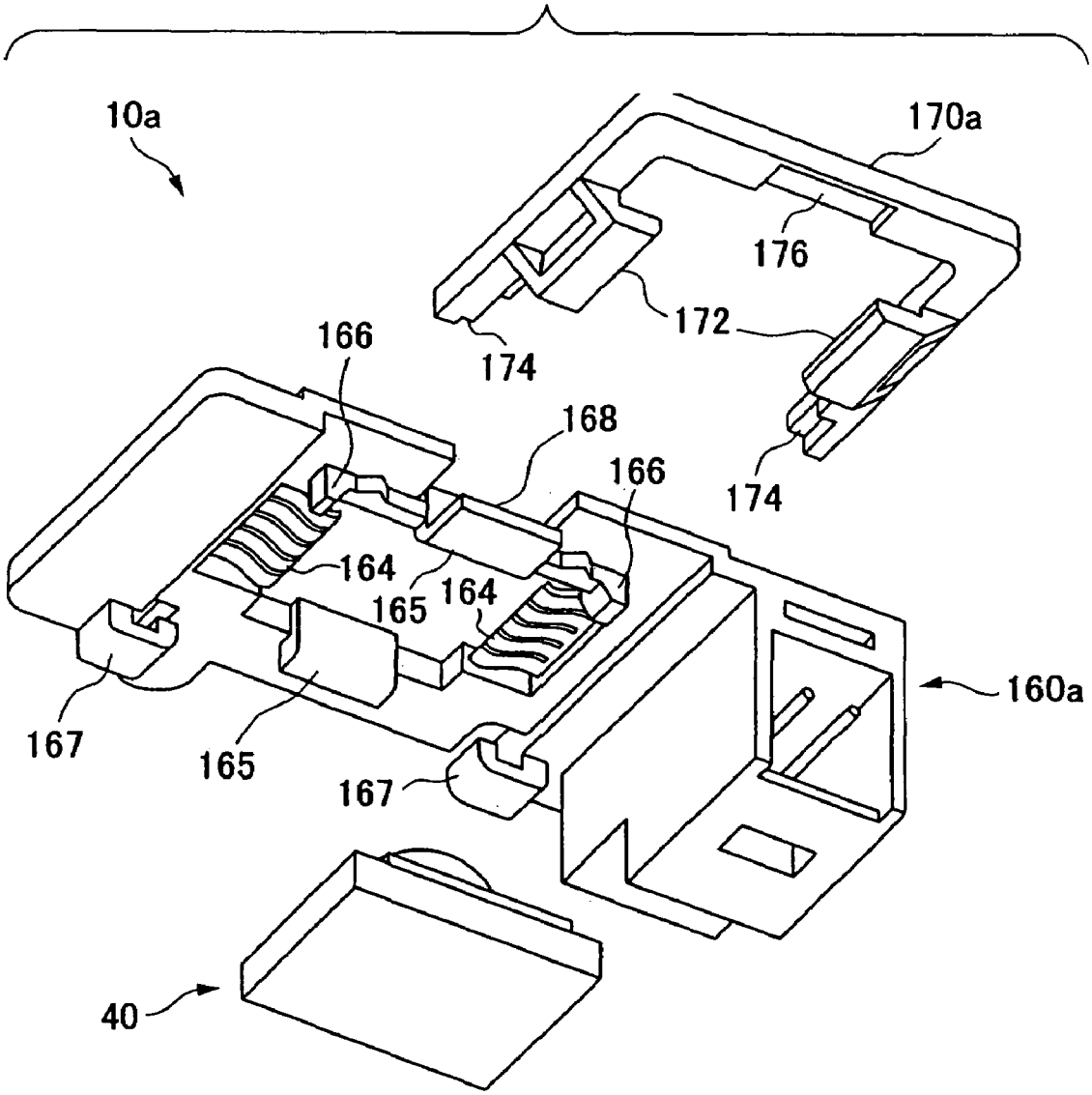
FIG. 6 is an exploded perspective view showing the light emitting module 10*a* seen from below.
Figure 7:
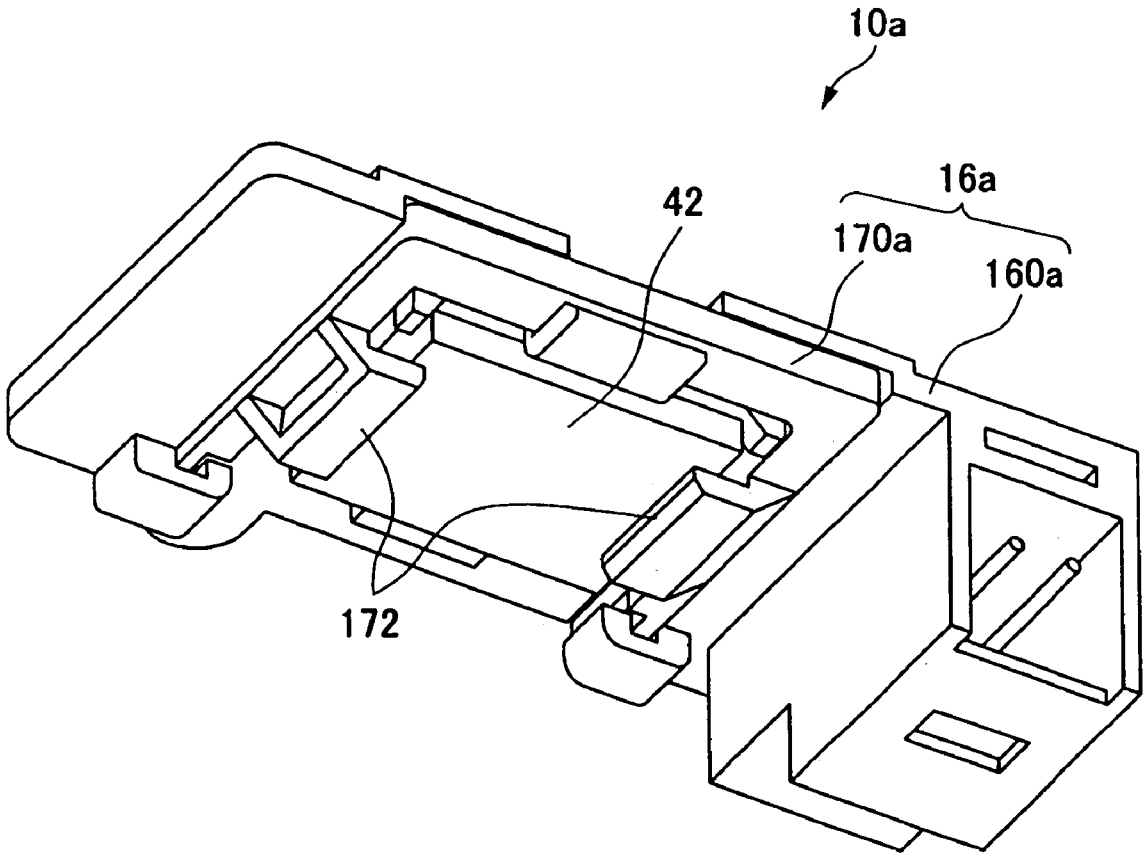
FIG. 7 is an assembled perspective view showing the light emitting module 10*a* seen from below.

FIGS. 5, 6 and 7 are perspective views showing the light emitting module 10*a*. FIGS. 5 and 6 are exploded perspective views showing the light emitting module 10*a* seen from above and below, respectively. FIG. 7 is an assembled perspective view showing the light emitting module 10*a* seen from below.

The light emitting module 10*a* includes the LED unit 40 and the attachment 16*a*. The LED unit 40 has the semiconductor light emitting unit 44, a radiating board 42, and a contact 46. The semiconductor light emitting unit 44 is directly fixed to an upper surface of the radiating board 42 The contact 46 formed on the radiating board 42 serves to input a power for causing the semiconductor light emitting unit 44 to emit a light. The attachment 16*a* surrounds and holds the LED unit 40 in a state in which at least a part of the lower and side surfaces of the radiating board 42 and the upper part of the semiconductor light emitting unit 44 are open. In the example, the LED unit 40 is held in a state in which most of the lower surface of the radiating board 42 is exposed. Moreover, the attachment 16*a* has a power supply portion 162 for supplying a power that causes the semiconductor light emitting unit 44 to emit a light from an external power plug to the contact 46.

The radiating board 42 is a material having a high thermal conductivity and a low coefficient of thermal expansion, for example, ceramic. The radiating board has an almost rectangular shape. A pair of contacts 46 are formed on both ends in the longitudinal direction of the radiating board 42 with the semiconductor light emitting unit 44 interposed therebetween. The LED unit 40 further has a dome lens 48 fixed to the upper surface of the radiating board 42 and serving to cover the semiconductor light emitting unit 44. The dome lens 48 is, for example, a hollow glass lens and has a diameter which is almost equal to that of the side surface of the radiating board 42.

The light emitting module 10*a* holds the LED unit 40 in a state in which most of the lower surface of the radiating board 42 is open. Therefore, a heat generated with the light emission of the semiconductor light emitting unit 44 is radiated efficiently. Accordingly, a rise in the temperature of the semiconductor light emitting unit 44 is suppressed and a high light emitting efficiency is obtained. Consequently, it is possible to continuously emit a light having a high luminance. Moreover, the light emitting module 10*a* holds the LED unit 40 in a state in which at least a part of the side surface of the radiating board 42 is exposed. In the case in which the light emitting module 10*a* is to be fixed to the lighting unit, consequently, the radiating board 42 can be directly positioned. Thus, it is possible to enhance precision in the position of the semiconductor light emitting unit 44, that is, precision in the position of the light source. Furthermore, the attachment 16*a* surrounds and holds the LED unit 40. Therefore, there is no possibility that hands or tools might touch the contact 46 of the LED unit 40, and foreign matters can be prevented from sticking to the contact 46.

The attachment 16*a* includes an attachment body 160*a* and a lower surface support member 170*a*. The attachment body 160*a* energizes the LED unit 40 downward. The lower surface support member 170*a* is slid and fitted in the attachment body 160*a* from a side and interposes and holds the LED unit 40 together with the attachment body 160*a*. According to such a structure, the LED unit 40 can be stably held by the pressing force of the attachment body 160*a*. Because of the structure in which the lower surface support member 170*a* is slid and fitted in the attachment body 160*a* from the side, moreover, the height of the light emitting module 10*a* can be reduced.

The attachment body 160*a* has the power supply portion 162. The power supply portion 162 includes an input portion 163 connected electrically and a spring terminal 164. The input portion 163 acquires a power for causing the semiconductor light emitting unit 44 to emit a light when an external power plug is inserted. The spring terminal 164 presses the upper surface of the contact 46 downward and is thus connected electrically to the contact 46, thereby supplying a power for causing the semiconductor light emitting unit 44 to emit a light. The positive and negative sides of the spring terminal 164 come in contact with the contact 46 by means of a plurality of independent springs, respectively. Accordingly, the contact 46 and the spring terminal 164 have a highly reliable electrical connection. More specifically, the light emitting module 10*a* can stably implement the hold of the LED unit 40 and the supply of a power by the energizing force of the spring terminal 164.

As shown in FIG. 6, the attachment body 160*a* has board guides 165 and 166 for positioning the LED unit 40 with respect to the attachment body 160*a*. The board guides 165 and 166 are provided at an almost identical interval to the external shape of the radiating board 42, and the side surfaces of the radiating board 42 are guided by slanted faces provided on their inside surfaces, thereby positioning the LED unit 40.

The lower surface support member 170*a* has an almost U shape. A tip engagement portion 174 is provided on each of the tips of open ends of the U-shaped lower surface support member, and a rear end engagement portion 176 is provided in a central part on the side opposite the tip engagement portion 174. The attachment body 160*a* is provided with an engagement click 167 engaged with each of the tip engagement portions 174 and serving to hold the tip engagement portion 174 on the attachment body 160*a* side. Furthermore, the attachment body 160*a* is provided with an engagement click 168 for holding the rear end engagement portion 176 on the attachment body 160*a* side when the engagement click 167 and the tip engagement portion 174 are engaged with each other. The lower surface support member 170*a* further has a contact holding portion 172 for holding the lower surface of the LED unit 40 and maintaining contact between the contact 46 and the spring terminal 164.

The light emitting module 10*a* is assembled by following procedure. First, the LED unit 40 is assembled into the attachment body 160*a* in a state in which the contact 46 of the LED unit 40 is opposed to the spring terminal 164 of the attachment body 160*a*. Next, the tip engagement portion 174 and the rear end engagement portion 176 are slid to be engaged with the engagement click 167 and the engagement click 168 respectively with the contact holding portion 172 of the lower surface support member 170*a* placed on a lower side. Consequently, the contact holding portion 172 is guided along the lower surface of the LED unit 40 and the LED unit 40 is fixed in a state shown in FIG. 7. Thus, the assembly of the light emitting module 10*a* is finished.

Figure 8:
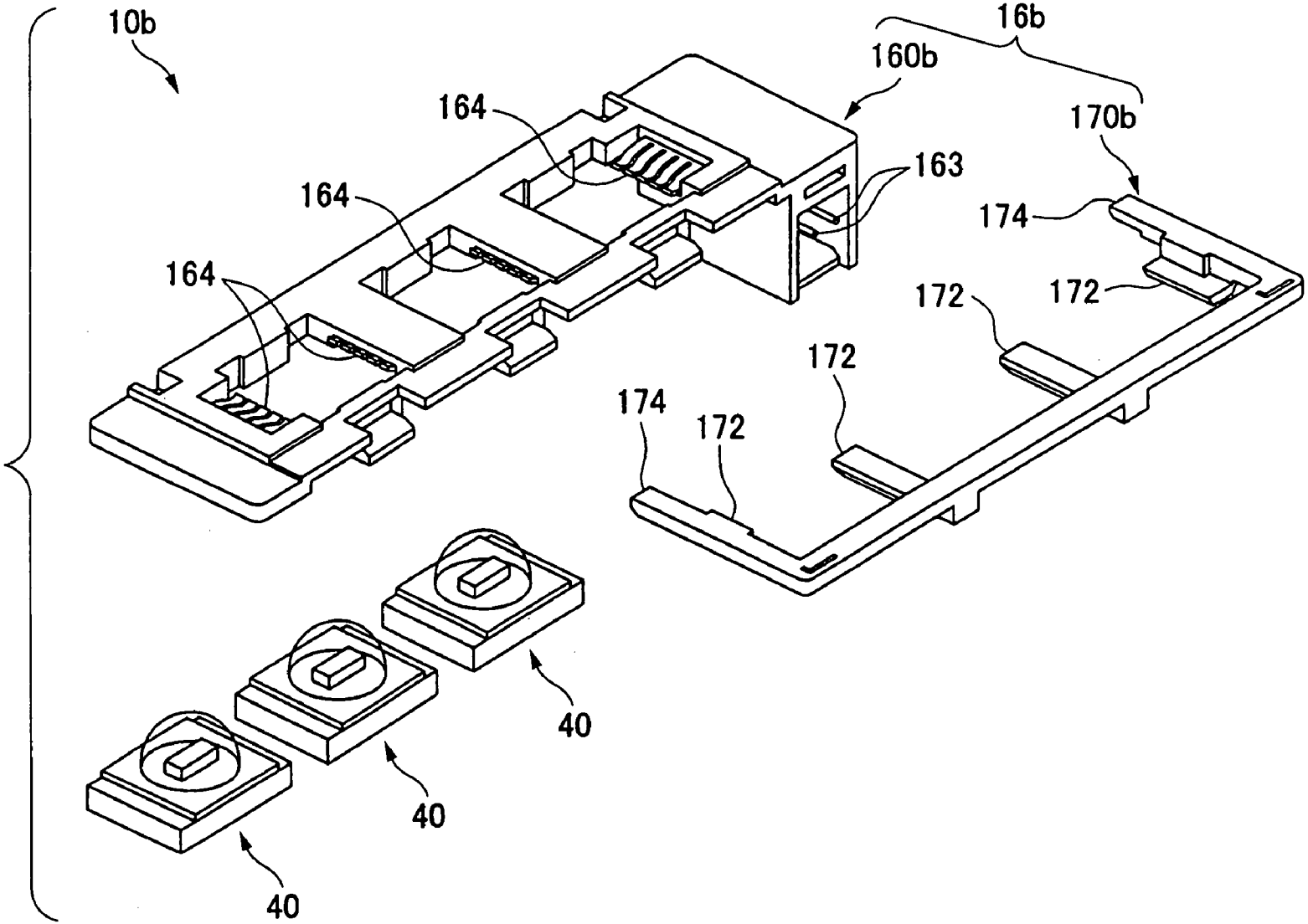
FIG. 8 is an exploded perspective view showing a light emitting module 10*b* seen from above.
Figure 9:
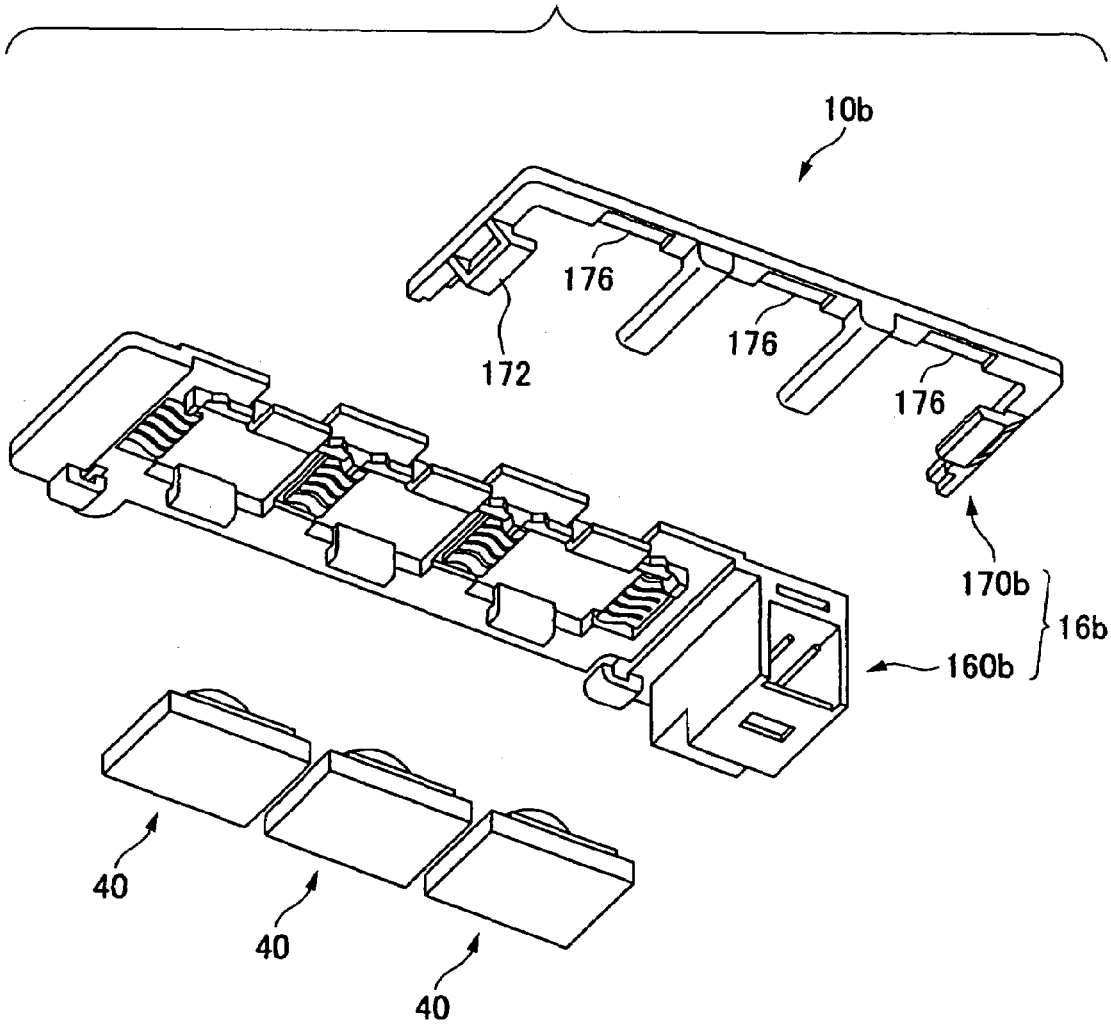
FIG. 9 is an exploded perspective view showing the light emitting module 10*b* seen from below.
Figure 10:
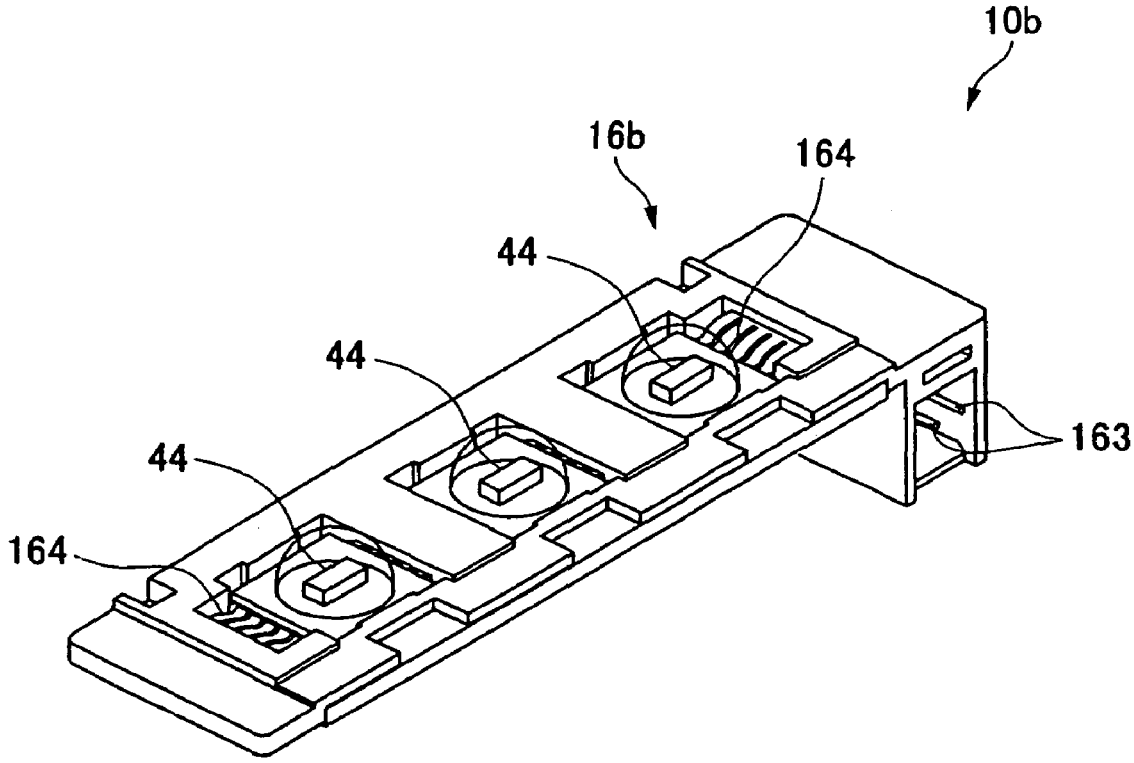
FIG. 10 is an assembled perspective view showing the light emitting module 10*b* seen from above.

FIGS. 8, 9 and 10 are perspective views showing a light emitting module 10*b* for mounting a plurality of LED units 40 thereon. FIGS. 8 and 9 are exploded perspective views showing the light emitting module 10*b* seen from above and below, respectively. FIG. 10 is a perspective view showing a state in which the light emitting module 10*b* is assembled. Although the light emitting module 10*b* according to the example has three LED units 40 arranged in a transverse line, the number and array of the LED units 40 is not restricted by the example. Moreover, the structures that are the same as those as the light emitting module 10*a* shown in FIGS. 5, 6 and 7 have been provided the same reference numerals and, therefore, description of these structures will be omitted. Description will be given to different structures from the light emitting module 10*a*.

The light emitting module 10*b* has three LED units 40 and an attachment 16*b* for surrounding and holding each of the three LED units 40. The attachment 16*b* includes an attachment body 160*b* and a lower surface support member 170*b*. The attachment body 160*b* has three pairs of spring terminals 164 for supplying a power to the three LED units 40, respectively. The power is supplied to each of the three pairs of spring terminals 164 through an input portion 163. The lower surface support member 170*b* includes a contact holding portion 172 for supporting the back face of a portion in which the spring terminal 164 and the contact 46 come in contact with each other.

Figure 11:
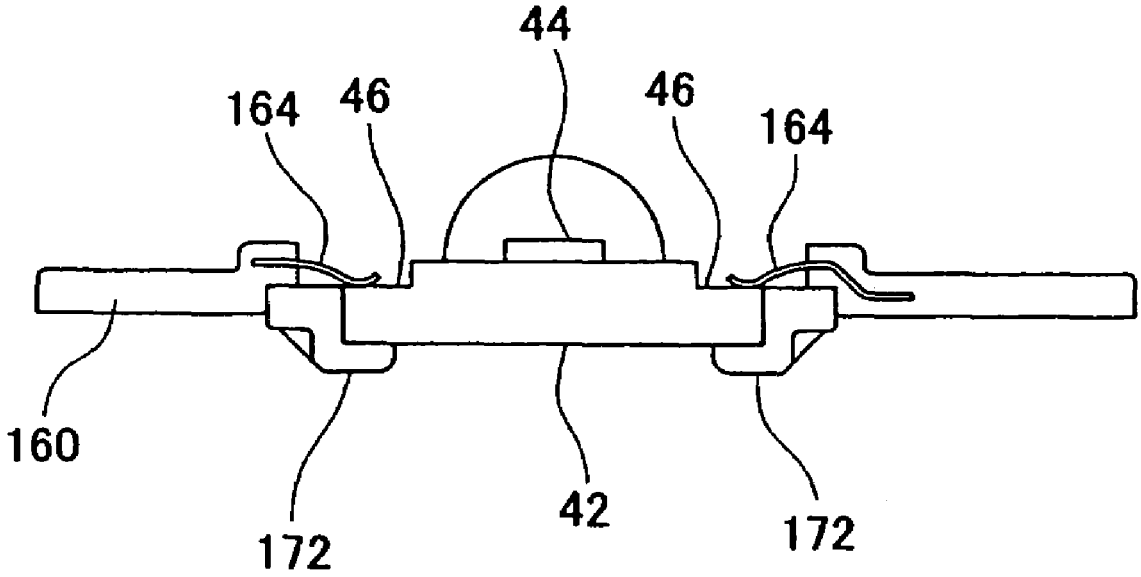
FIG. 11 is a sectional view taken along a contact 46 and a spring terminal 164 in a light emitting module 10.

FIG. 11 is a sectional view taken along the contact 46 and the spring terminal 164 of the light emitting modules 10*a* and 10*b*. As shown in FIG. 11, the contact holding portion 172 supports a portion of the lower surface of the radiating board 42 which is opposite the contact 46. Accordingly, it is possible to reliably maintain contact of the spring terminal 164 with the contact 46.

Figure 12:
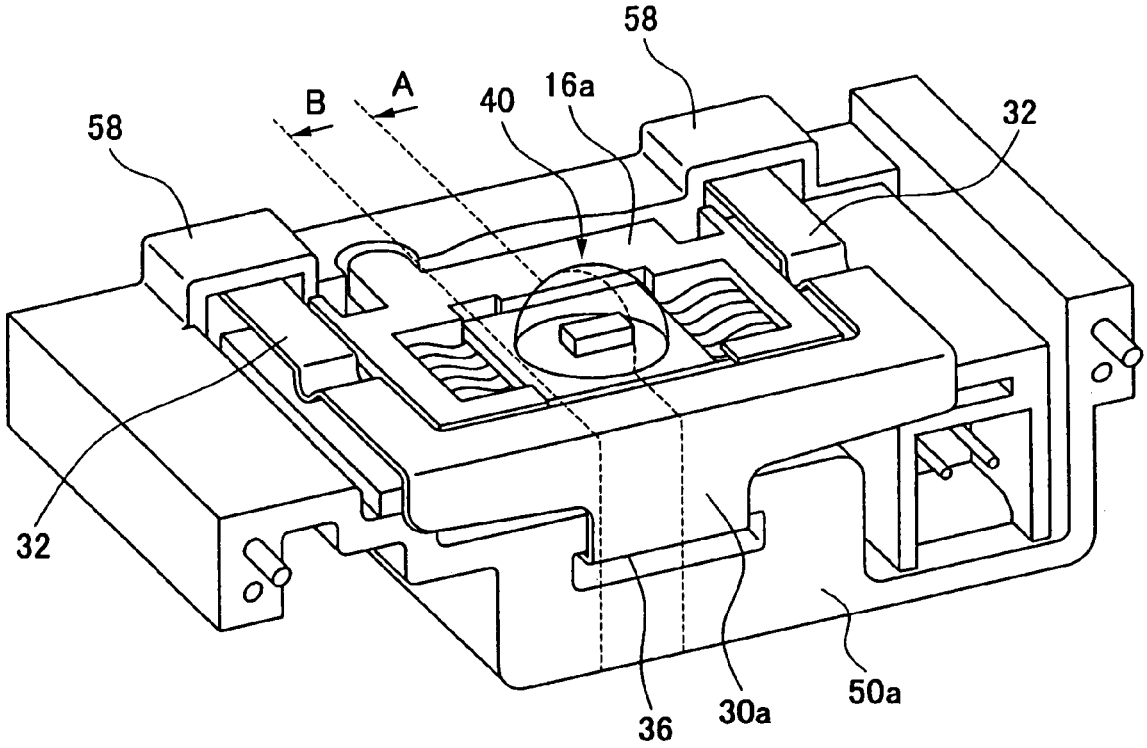
FIG. 12 is a perspective view showing a state in which the light emitting module 10*a* is fixed to a light source pedestal 50*a* with a clip 30*a*.
Figure 13:
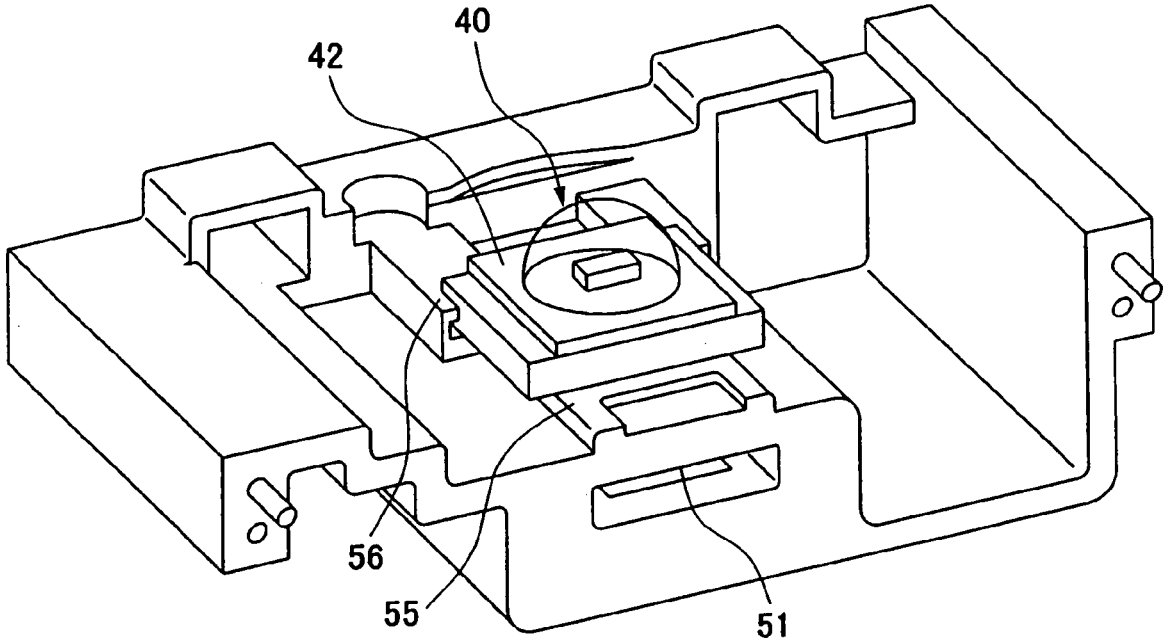
FIG. 13 is a view showing a state in which the light source pedestal 50*a* directly positions and supports an LED unit 40.

FIG. 12 is a perspective view showing a state in which the light emitting module 10*a* is fixed to a light source pedestal 50*a* with a clip 30*a*. Moreover, FIG. 13 shows a state in which the clip 30*a* and the attachment 16*a* are omitted from FIG. 12. As shown in FIG. 13, the light source pedestal 50*a* has a positioning portion 56 for directly abutting the side surface of the radiating board 42 in order to position the radiating board 42. The light source pedestal also has a support surface 55 for directly coming in contact with the lower surface of the radiating board 42 to support the LED unit 40. Furthermore, the light source pedestal 50*a* has an engagement surface 51 formed almost parallel with the support surface 55 below the support surface 55.

As shown in FIG. 12, the clip 30*a* has a pair of upper surface pressing portions 32 for pressing both left and right ends of the upper surface of the attachment 16*a* against the light source pedestal 50*a*. The clip 30*a* also has a lower surface engagement portion 36 to be engaged with the engagement surface 51 shown in FIG. 13. Left and right ends of the upper surface of the attachment 16*a* and the engagement surface 51 are interposed between the upper surface pressing portions 32 and the lower surface engagement portion 36 of the clip 30*a*, thereby pressing the lower surface of the radiating board 42 against the support surface 55 through the attachment 16*a*. The upper surface of the attachment 16*a* and the engagement surface 51 being interposed by the portions clip 30*a* causes the spring terminal 164 to strongly press against the contact 46. Consequently, it is possible to enhance the reliability of the electrical connection of the contact 46 and the spring terminal 164.

Moreover, the light source pedestal 50*a* has a holding portion 58 for abutting on the upper surface of the tip of the upper surface pressing portion 32. The holding portion 58 holds the tip of the upper surface pressing portion 32 so that the light emitting module 10 can be pressed against the light source pedestal 50*a* more reliably. Accordingly, the clip 30*a* can stably fix the light emitting module 10*a* to the light source pedestal 50*a*, and furthermore, a heat generated from the semiconductor light emitting unit 44 can be efficiently radiated to the light source pedestal 50*a* through the radiating board 42. Consequently, a reduction in the quantity of a light of the semiconductor light emitting unit 44 caused by the heat can be prevented.

Figure 14:
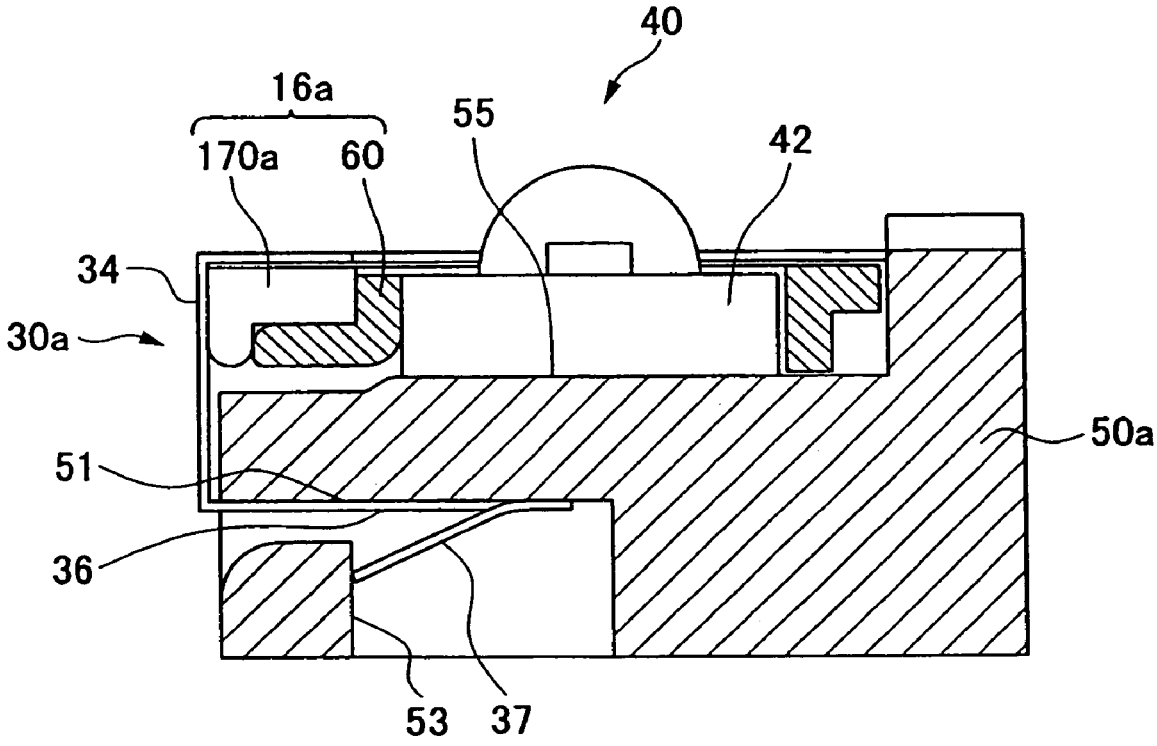
FIG. 14 is a sectional view showing an A cross-section in FIG. 12.
Figure 15:
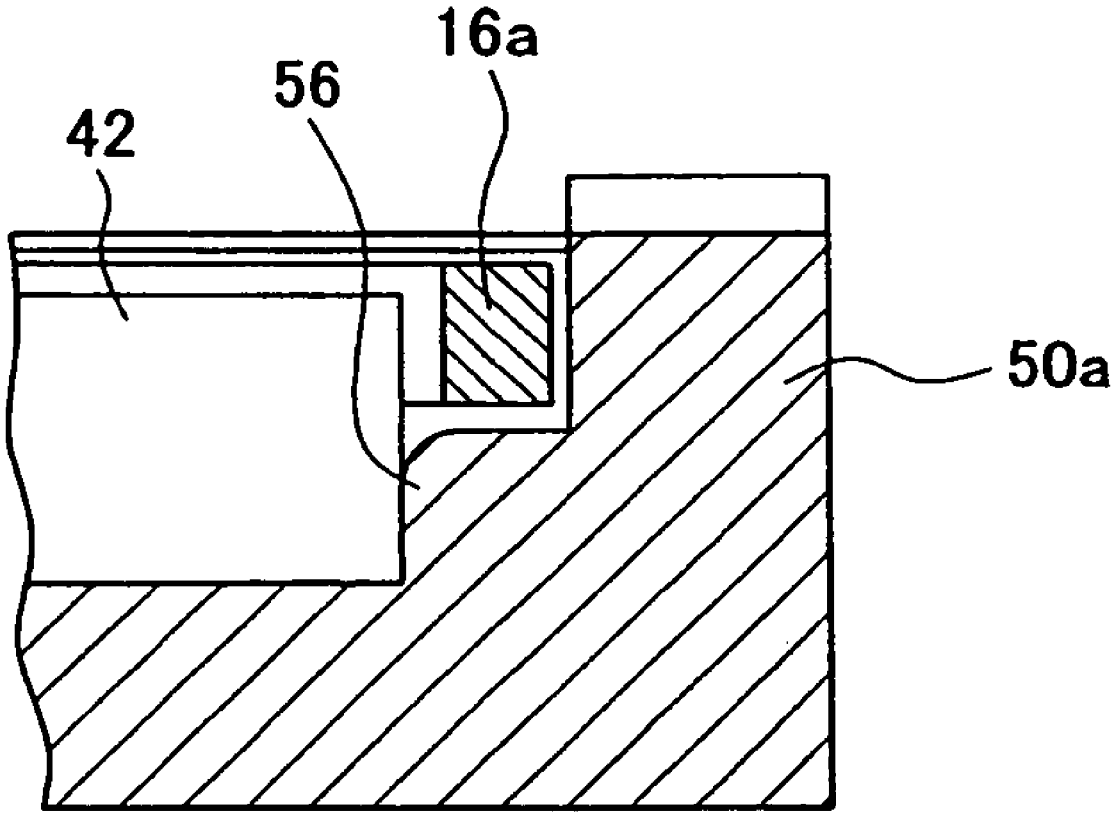
FIG. 15 is a sectional view showing a B cross-section in FIG. 12.

FIGS. 14 and 15 are sectional views showing an A cross-section and a B cross-section of FIG. 12, respectively. A cutback 37 is provided on the tip of the lower surface engagement portion 36 of the clip 30*a*. The cutback 37 is engaged with an engagement surface 53 provided vertically below the engagement surface 51 so that the clip 30*a* is fixed. The clip 30*a* has a side surface pressing portion 34 that abuts the side surface of the attachment 16*a*. The side surface pressing portion 34 presses the side surface of the attachment 16*a* against the inner part of the light source pedestal 50*a* (a rightward direction of the drawing) when the cutback 37 is engaged with the engagement surface 53. The attachment 16*a* has a regulating rib 60 that abuts a side surface in the radiating board 42, the side surface being provided on the opposite side of radiating board 42 with respect to the positioning portion 56. When the side surface pressing portion 34 presses the side surface of the attachment 16*a* against the light source pedestal 50*a*, the regulating rib 60 presses the radiating board 42 against the positioning portion 56 as shown in FIG. 15. Consequently, the LED unit 40 is directly positioned so that it abuts the light source pedestal 50*a*. There is a constant clearance in a horizontal direction between the attachment 16*a* and the light source pedestal 50*a* when the radiating board 42 abuts on the positioning portion 56. According to such a structure, the LED unit 40 is directly positioned with high precision by the light source pedestal 50*a*.

According to the structure, the reference position of the light emitting region of the semiconductor light emitting unit 44 is positioned with high precision in a horizontal direction with respect to the positioning portion 56 of the light source pedestal 50*a*. The reflector 80*a* and the lens 90*a* are positioned with high precision with respect to the assembly reference plane 59 and the positioning projection 57 as described above. By managing high precision from the positioning portion 56 to the assembly reference plane 59 and the positioning projection 57, it is possible to maintain the relative positions in the horizontal direction of the reference position of the light emitting region of the semiconductor light emitting unit 44 with the reflector 80*a* and the lens 90*a* with high precision.

Furthermore, the LED unit 40 is stably fixed to the support surface 55 of the light source pedestal 50*a* in a vertical direction. The positions of the reflector 80*a* and the lens 90*a* in the vertical direction are determined with high precision by the positioning projection 57 as described above. By managing a distance in the vertical direction from the support surface 55 for supporting the LED unit 40 to the positioning projection 57 with high precision, it is possible to maintain the relative positions in the vertical direction of the center of the light emitting region of the semiconductor light emitting unit 44 with the reflector 80*a* and the lens 90*a* with high precision.

As described above, the relative positions of the light emitting region of the semiconductor light emitting unit 44 with the reflector 80*a* and the lens 90*a* are maintained with high precision in both the horizontal and vertical directions of the first light source unit 100. Accordingly, the first light source unit 100 can irradiate a light generated from the semiconductor light emitting unit 44 to an outside with high precision. Furthermore, the radiating board 42 is mainly made of a material having a high thermal conductivity and a low coefficient of thermal expansion, for example, a metal or ceramic. Therefore, the external shape of the radiating board 42 is not easily changed by the heat generated from the semiconductor light emitting unit 44. Accordingly, the relative positions of the light emitting region of the semiconductor light emitting unit 44 with the reflector 80*a* and the lens 90*a* are not changed by the generation of the heat of the semiconductor light emitting unit 44 so that the first light source unit 100 can irradiate the light of the semiconductor light emitting unit 44 to the outside with higher precision.

Since all of the light source units 100, 200 and 300 according to the exemplary embodiment have the same structures, the relative positions of the reflector 80*a* and the lens 90*a* with the semiconductor light emitting unit 44 are maintained with high precision. In particular, the reference of the semiconductor light emitting unit 44, for example, the center of an optical region is aligned with the optical center of the reflector 80*a* with high precision. Accordingly, the lighting unit 500 for a vehicle can form a predetermined light distribution pattern with high precision.

As is apparent from the above description, according to the exemplary embodiment, the lighting unit 500 for a vehicle effectively radiates the heat generated from the semiconductor light emitting unit 44 so that a reduction in the luminance of the semiconductor light emitting unit 44 can be prevented. By maintaining the relative positions of optical systems such as the reflector 80*a* and the lens 90*a* with the semiconductor light emitting unit 44 with high precision, moreover, it is possible to form a light distribution pattern with high precision.

In another exemplary embodiment, the attachment 16 includes a power circuit in the middle of a power supply path between the input portion 163 and the spring terminal 164. The power circuit converts a voltage and a current to be supplied from an external power plug to the input portion 163 into a current and a voltage for operating the LED unit 40. The power circuit is formed on a circuit board incorporated in the attachment 16. The circuit board and the power supply portion 162 are connected to each other through a soft flexible substrate. The flexible substrate is a sufficient length for the incorporation and connection of the circuit board. Since the flexible substrate has a predetermined flexure, it can be prevented from being disconnected even if a vibration is applied to the lighting unit 500 for a vehicle. Moreover, the attachment 16 may further include a fail safe circuit or an interface circuit in the middle of the power supply path from the input portion 163 to the spring terminal 164.

The circuit board is provided apart from the radiating board 42. Accordingly, the temperature of the semiconductor light emitting unit 44 can be prevented from being raised by the heat generated from the power circuit. Moreover, it is desirable that the circuit board should be covered with a metal case having a high thermal conductivity and a high radiating property. Consequently, it is possible to efficiently radiate the heat generated from the power circuit. Furthermore, it is desirable that the metal case should be connected to the ground plane of the circuit board. Consequently, it is possible to effectively block the radiation of a noise generated from the power circuit onto an outside.

Moreover, it is desirable that the circuit board should be exchange able with respect to the attachment 16. By exchanging power circuits having different properties, for example, current values, consequently, it is possible to easily implement a light emitting module 10 having a different property, while using the same LED unit 40. By causing one power circuit to correspond to one LED unit 40, thus, it is possible to advantageously standardize the LED unit 40.

While the invention has been described with reference to the exemplary embodiment, the technical scope of the invention is not restricted to the description of the exemplary embodiment. It is apparent to the skilled in the art that various changes or improvements can be made. It is apparent from the description of claims that the changed or improved configurations can also be included in the technical scope of the invention.

What is claimed is:

1. A light emitting module to be used for a lighting unit, comprising:

an LED unit having a semiconductor light emitting unit, a radiating board for directly fixing the semiconductor light emitting unit to an upper surface, and a contact formed on the radiating board and serving to input a power to cause the semiconductor light emitting unit to emit a light; and an attachment having a power supply portion for surrounding and holding the LED unit and supplying a power to cause the semiconductor light emitting unit to emit a light from an external power plug to the contact in a state in which at least a part of lower and side surfaces of the radiating board and an upper part of the semiconductor light emitting unit are open.

2. The light emitting module according to claim 1, wherein the attachment has:

an attachment body for positioning the LED unit; and a lower surface support member slid and fitted in the attachment body from a side and serving to interpose and hold the LED unit together with the attachment body.

3. The light emitting module according to claim 2, wherein the attachment body includes the power supply portion, the lower surface support member supports the lower surface of the radiating board, and the power supply portion downward energizes the contact formed on the upper surface of the radiating board, thereby carrying out an electrical connection to the contact.

4. The light emitting module according to claim 3, wherein the lower surface support member supports a portion in the lower surface of the radiating board which is opposed to the contact.

5. A lighting unit to be used for illumination, comprising:

an LED unit having a semiconductor light emitting unit, a radiating board for directly fixing the semiconductor light emitting unit to an upper surface, and a contact formed on the radiating board and serving to input a power to cause the semiconductor light emitting unit to emit a light;

an attachment having a power supply portion for surrounding and holding the LED unit and supplying a power to cause the semiconductor light emitting unit to emit a light from an external power plug to the contact in a state in which at least a part of lower and side surfaces of the radiating board and an upper part of the semiconductor light emitting unit are open; and a light source pedestal having a support surface for supporting the LED unit in direct contact with the lower surface of the radiating board, and a positioning portion for positioning the LED unit in direct abutment on the side surface of the radiating board.

6. The lighting unit according to claim 5, further comprising:

an engagement surface formed in almost parallel with the support surface below the support surface in the light source pedestal; and a clip for interposing an upper surface of the attachment and the engagement surface, thereby pressing the lower surface of the radiating board against the support surface through the attachment.

7. The lighting unit according to claim 6, wherein the power supply portion downward energizes the contact formed on the upper surface of the radiating board, thereby carrying out an electrical connection to the contact, and the clip interposes the upper surface of the attachment and the engagement surface so that the power supply portion energizes the contact more strongly.

8. The lighting unit according to claim 6, wherein the attachment further has a regulating rib to abut on a side surface in the radiating board which is provided on an opposite side of the positioning portion of the light source pedestal, and the clip presses a side surface of the attachment toward the light source pedestal so that the regulating rib presses the radiating board against the positioning portion, thereby positioning the LED unit.

9. A light emitting module, comprising:

a light unit, comprising a semiconductor light emitting unit, comprising an upper part, a radiating board, comprising an upper surface, a lower surface and side surfaces, the semiconductor light emitting unit directly fixed to the upper surface of the radiating board, and a contact formed on the radiating board, the contact serving to input a power that causes the semiconductor light emitting unit to emit a light; and an attachment that surrounds and holds the such that at least a part of the lower and side surfaces of the radiating board and the upper part of the semiconductor light emitting unit are open, the attachment comprising a power supply portion that supplies the power that causes the semiconductor light emitting unit to emit the light from an external power plug to the contact.

10. The light emitting module according to claim 9, wherein the attachment comprises:

an attachment body that positions the light unit; and a lower surface support member that is fitted in the attachment body and holds the light unit together with the attachment body.

11. The light emitting module according to claim 10, wherein the attachment body includes the power supply portion, the lower surface support member supports the lower surface of the radiating board, and the power supply portion energizes the contact formed on the upper surface of the radiating board, thereby providing an electrical connection to the contact.

12. The light emitting module according to claim 11, wherein the lower surface support member supports a portion in the lower surface of the radiating board which is opposed to the contact.

13. A lighting unit, comprising:

the light emitting module of claim 9; and a light source pedestal, comprising a support surface that supports the light unit, the support surface in direct contact with the lower surface of the radiating board, and a positioning portion that positions the light unit so that the light unit directly abuts a side surface of the radiating board.

14. The lighting unit according to claim 13, the light source pedestal further comprising:

an engagement surface formed almost parallel with the support surface, the engagement surface provided below the support surface; and a clip, an upper surface of the attachment and the engagement surface being interposed between portions of the clip, thereby pressing the lower surface of the radiating board against the support surface through the attachment.

15. The lighting unit according to claim 14, wherein the power supply portion energizes the contact formed on the upper surface of the radiating board, thereby providing an electrical connection to the contact, and the upper surface of the attachment and the engagement surface are interposed between portions of the clip so that the power supply portion energizes the contact more strongly.

16. The lighting unit according to claim 14, wherein the attachment further comprises a regulating rib that abuts a side surface in the radiating board, the side surface being opposite the positioning portion of the light source pedestal, and the clip presses a side surface of the attachment toward the light source pedestal so that the regulating rib presses the radiating board against the positioning portion, thereby positioning the light unit.

17. The light emitting module according to claim 1, wherein the contact comprises a pair of the contacts, wherein the contacts of the pair of contacts are formed on opposite ends in a longitudinal direction of the radiating board, and the semiconductor light emitting unit is interposed between the contacts.

* * * * *